United States Patent [19]

Turner, deceased

[11] 4,408,116

[45] Oct. 4, 1983

[54] SUPERHEATED STEAM GENERATOR

[75] Inventor: Jesse R. Turner, deceased, late of Glenwood, Ark., by Allene A. Turner; executrix

[73] Assignee: Superthermal, Inc., New Hope, Ark.

[21] Appl. No.: 189,091

[22] Filed: Sep. 22, 1980

[51] Int. Cl.[3] ..... F22B 1/28; F22B 27/00; B05B 15/02

[52] U.S. Cl. ..... 219/273; 122/40; 219/275; 219/326; 239/110

[58] Field of Search ..... 219/271–276, 219/326; 122/40; 239/110

[56] References Cited

U.S. PATENT DOCUMENTS

| | | | |
|---|---|---|---|
| 213,556 | 3/1879 | Everding | 122/40 |
| 734,871 | 7/1903 | Hopwood et al. | 219/273 X |
| 1,646,912 | 10/1927 | Hodshon | 219/273 X |
| 1,753,522 | 4/1930 | Larsen | 239/110 X |
| 1,949,182 | 2/1934 | Roberts | 239/110 |
| 2,606,272 | 8/1952 | Platt | 219/275 X |
| 3,243,575 | 3/1966 | Vignere | 219/273 |
| 3,419,666 | 12/1968 | Groom | 219/273 X |

FOREIGN PATENT DOCUMENTS

| | | | |
|---|---|---|---|
| 92701 | 11/1968 | Mexico | 219/273 |

*Primary Examiner*—A. Bartis

*Attorney, Agent, or Firm*—Stephen D. Carver

[57] ABSTRACT

A superheated steam generator for crude oil recovery systems includes a centrally disposed second stage electric superheated steam generating tank surrounded and fed by a plurality of radially spaced first stage electric steam generating tanks. A primary manifold system supplies water to each of the first stage tanks and includes a central reservoir communicating with a plurality of constriction fittings. Each constriction fitting includes a tapered nozzle directed interiorly of the manifold toward a removable plug closing an associated inspection orifice permitting cleaning of the manifold and removal of the associated constriction fitting. Tubes coupled to opposite external ends of the constriction fittings deliver water to the first stage tanks, and are coupled to elongated tubes having portions extending longitudinally interiorly of the first stage tanks. A rigid tubular sheath coaxially surrounds and protects each of the last mentioned tubes, and defines a steam output passageway between the sheath and the mouth of each first stage tank. Steam from the first stage tanks is transmitted to the second stage tank by a plurality of radial equal length conduits extending between each first stage steam output passageway and the central manifold and by a pipe connected to the central manifold and extending longitudinally interiorly of the second stage tank. A steam output passageway is defined between the latter pipe and a rigid pipe extending between the central steam manifold and the mouth of the second stage heater tank body.

1 Claim, 7 Drawing Figures

SUPERHEATED STEAM GENERATOR

BACKGROUND OF THE INVENTION

The present invention relates generally to high temperature steam generators. More particularly, the present invention relates to superheated steam generators ideally adapted for use in recovering crude oil of very low specific gravity.

In the prior art a variety of techniques have been proposed for injecting steam within the lowermost confines an oil well to facilitate subsequent liberation of heavy crude oil. Once sufficient steam has been injected into a well, the reduced viscosity of the resultant substance facilitates pumping through conventional techniques for subsequent refining. In the past it has been very difficult to generate or transmit steam at sufficient temperature and pressure to properly liquify the heavy crude oil at the well bottom. Prior art attempts have also failed in temperature regulation. Prior art devices of which I am aware usually vary in output temperature over extremely wide temperature differentials.

I have also discovered previously that a basic heater system may be formed from an internal tank positioned coaxially within an outer shroud and heated by molten metal disposed therebetween. A central, coaxially aligned passageway system extending interiorly of the apparatus inputs raw water interiorly of the tank through a central passage tube. Subsequently generated steam is outputted through a passageway coaxially defined between the input pipe and the output header. This basic construction is shown in Mexican patent No. 97201, issued November 1968. However, with the above mentioned device, the steam output temperature would vary extremely widely. Liquid levels within the input tank would vary constantly, resulting in irregular vaporization. Temperature fluctuation between Four Hundred to Sixteen Hundred Degrees fahrenheit were experienced, resulting in inadvertent stopping of crude oil pumps in response to build-up of improperly heated steam.

Therefore I have endeavored to build a new system in which temperature control may be limited over very specific limits, and with which prior disadvantages may be readily overcome.

SUMMARY OF THE INVENTION

The present invention comprises a two stage superheated steam generator which preferably includes plurality of radially spaced-apart first stage heaters which feed a centrally disposed second stage heater.

Preferably each of the heaters includes an inner, generally cylindrical tank surrounded by a substantially coaxially positioned casing. A meltable preferably metallic heat transfer substance is disposed between the casing and the tank, and is melted by one or more electric heating elements. Heat will be distributed evenly about the periphery of the inner tank to generate steam in response to contact of the tank with the metal.

Each of the first stage heater tanks receives water through a manifold system. The manifold includes a central reservoir, and a plurality of output passageways provided in communication therewith. An input conduit leading to each first stage tank is coupled to the output passageways, and a unique flow construction nozzle is fitted within the output passageway to constrict the flow of water.

Steam outputted from each of the first stage generators is distributed via a spoke-like network of conduits which extend toward the center of the system, terminating in a steam manifold, which communicates interiorly of the second stage heater. The second stage heater generates superheated steam from the incoming relatively low temperature steam, which may then be forced to an external application within a crude oil well or the like.

Thus an object of this invention is to provide a superheated steam generator for use in recovering crude oil.

A similar object of this invention is to provide a two stage system for generating superheated steam of an extremely high temperature.

Yet another object of the present invention is to provide a superheated steam generator which is capable of a substantially constant temperature output.

Yet another object of the present invention is to provide a system of the character described for generating superheated steam in which the water input system is of high reliability. It is a feature of the present invention that the water intake manifold system employed includes a water passage constriction nozzle which prevents or minimizes jamming or blocking of important water transmission conduits.

A still further object of this invention is to provide a superheated steam generator characterized by relative compactness and extreme structural integrity.

Another object of this invention is to provide a system cabable of generating superheated steam while maintaining high electrical efficiency. An important feature of the present invention is that the superheated steam generation process is divided into first and second stages, and that the first stage heaters are arranged around the second stage heater in radially spaced-apart encircling relation therewith.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout to indicate like parts in the various views.

DETAILED DESCRIPTION OF THE DRAWINGS

Figure 1:
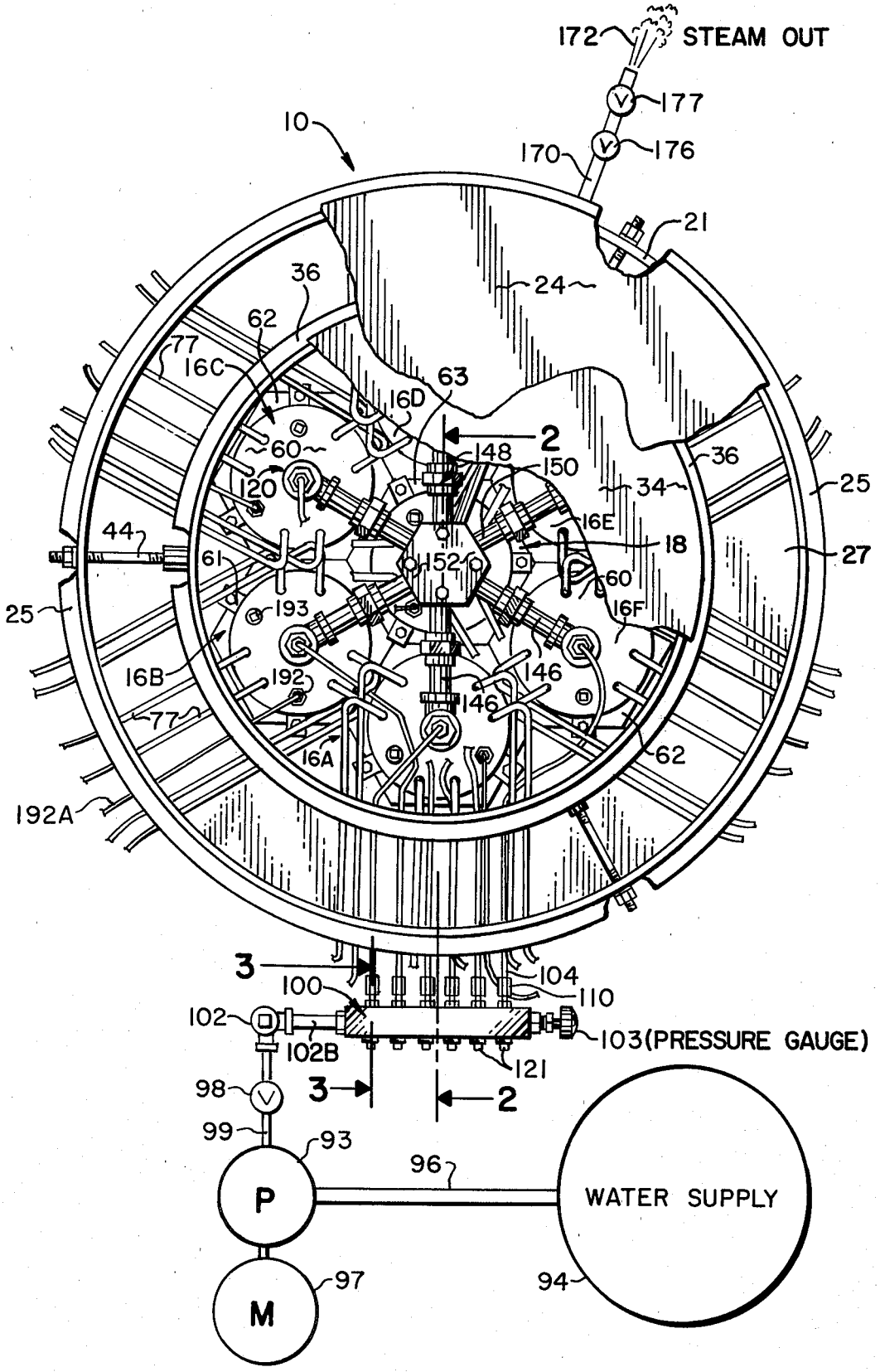
FIG. 1 is a combination pictorial and top plan view of a superheated steam generator constructed in accordance with the teachings of the present invention, with parts thereof broken away or shown in section for clarity.
Figure 2:
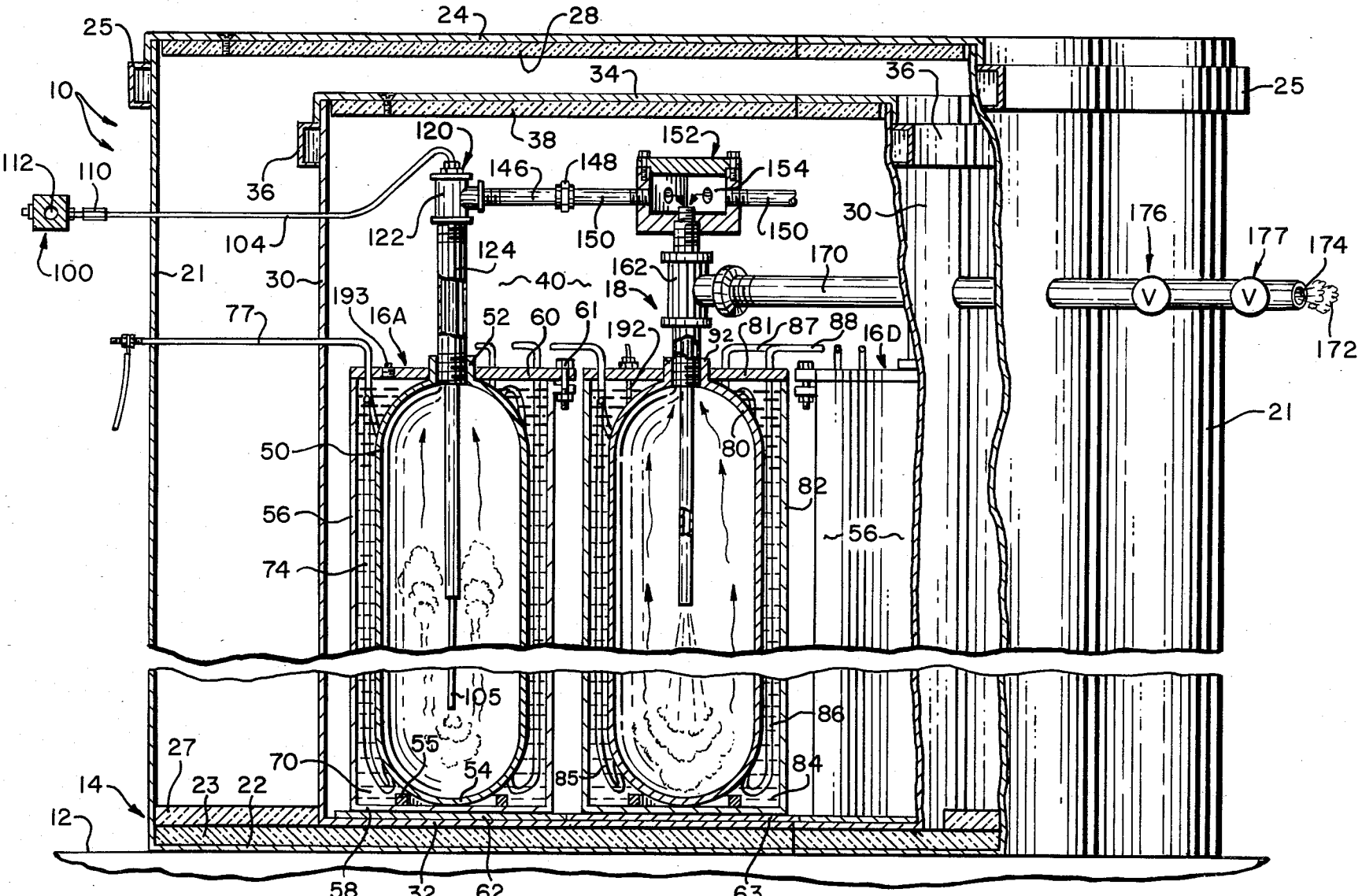
FIG. 2 is an enlarged, sectional view of the apparatus taken generally along line 2—2 of FIG. 1, with parts thereof broken away for clarity or omitted for brevity.

With initial reference now to FIGS. 1 and 2 of the drawings, a two stage system for generating superheated steam is generally designated by the reference numeral 10. The system 10 preferably includes a lower base 14 of generally circular cross section which is adapted to be disposed upon a supporting surface 12. The unit 10 includes a plurality of internal first stage heater tanks 16A–16F which are preferably disposed at radially spaced-apart intervals about the periphery of an internal second stage superheated steam generator 18. A dual housing is preferably employed, including an outermost generally tubular shroud 21 extending upwardly from a preferably metallic bottom 22. Housing 21 receives a top 24 of circular dimensions, which circumferentially terminates in a peripheral flange 25 comprised of reinforced angle iron, which encircles the apparatus and structurally braces it. It will be noted that a preferably circular insulation layer 28 is secured beneath top 24 to thermally insulate the unit 10.

An inner concentrically positioned tubular housing 30 also comprised of metal projects upwardly from a lower insulation layer 23, and comprises a bottom portion 32 of generally circular cross section, and an upper top portion 34 of circular cross section terminates at its edges in flanged reinforcement 36 comprised of angle iron which extends about its periphery. It will be noted that an insulation layer 38 is preferably secured beneath top 34 to thermally insulate the upper portion 40 of the inner compartment. It will be noted that housings 30 and 21 are maintained in generally coaxial relation by a plurality of radially spaced-apart studs 44 extending between flanges 25 and 36 and threadably secured thereto, and by lower insulation ring 27.

As best illustrated in FIG. 2, each of the tanks 16A–16F comprise an inner, generally cylindrical tank 50 having an upper, threaded mouth 52 and an integral bottom 54. Each body 50 is preferably coaxially disposed within an encircling casing 56 of greater diameter and circular cross section. Each casing 56 includes a circular bottom 58 and an upper top 60 secured via a plurality of conventional mounting bolts 61. The bottoms 58 of each of the first stage heater casings are preferably disposed upon polygonal support plates 62 which in turn rest upon the bottom 32 of inner housing 30. As noted previously, each of the first stage heaters 16A–16F are disposed radially about central second stage heater 18, and the number of sides of regular polygonal plates 62 will relate directly to the number of first stage tanks employed. It will be noted that the plates mutually abut and secure one another, each of the plates 62 associated with the first stage heaters properly abutting a facet of the central similarly shaped plate 63 upon which heater 18 rests.

Inner tanks 50 rest upon an internal support ring 55 disposed upon the bottom 58 of casing 56. Further support for the inner tank is provided by mouths 52, which is received through a suitable orifice provided within the tops 60.

Figure 5:
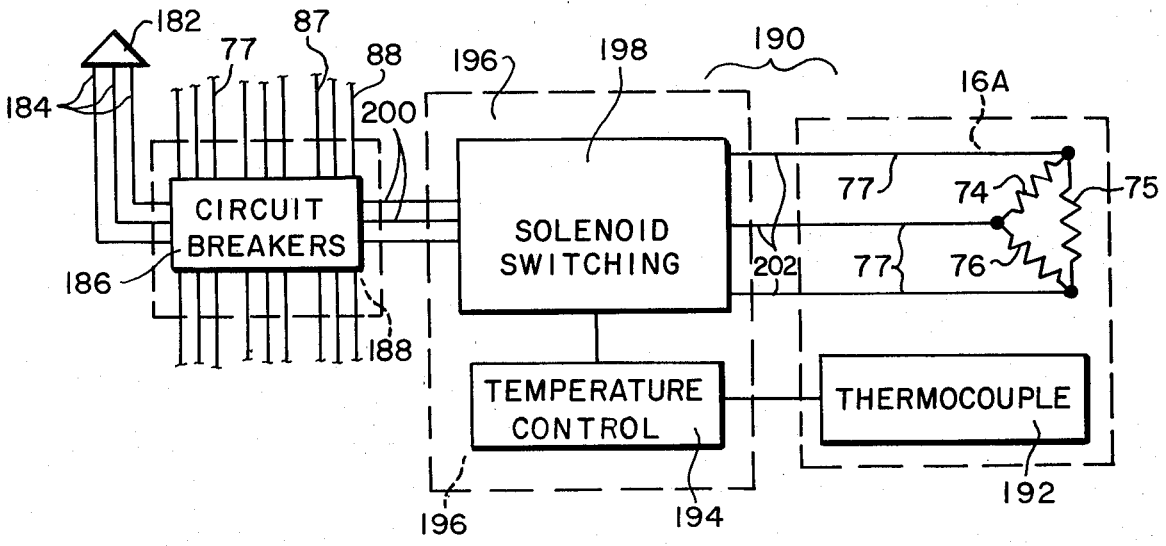
FIG. 5 is a block diagram of a suitable electrical control system used in conjunction with the present invention.

A meltable, preferably metallic heat transfer substance 70 is disposed within each of the heaters between the inner tank bodies 50 and the outer casing 56. The heat transfer substance, preferably lead, is melted by the electric heating elements 74, 75 preferably disposed within the preheater tanks between the inner tank bodies 50 and the casing 56 within the molten substance 70. Once the molten substance heats to a proper temperature heat will be evenly generated and distributed about the periphery of inner tank bodies 50. Each of the various tanks will include a plurality of heater elements, and preferably three are employed, disposed at radially spaced-apart 120 degree intervals within each of the tanks. The heater elements include electric conduits 77 which extend through the tops 60 of each tank and are bent appropriately to extend radially outwardly from the enclosure through suitable orifices provided through each housing 30, 21. The elements are controlled and wired as illustrated in FIG. 5, to be discussed later.

Heating tank 18 superheats steam generated within the preheater tanks 16A–16F. This tank is constructed substantially identically to the preheater tanks, including an inner tank body 80, an outer casing 82, and a molten substance 84 disposed between the tank body and casing. Electrical conduits 87, 88 extend through top 81 of the casing to energize the heater coils 85, 86 to thereby produce heat in the manner previously discussed. Heater casing 82 is disposed upon mounting plate 63 of preferably hexagonal dimensions. The mouth 92 of the second stage tank is received through a suitable orifice provided in top 81, and, as will later be discussed, is provided with suitable fittings for admitting and outputting steam.

Each of the heating elements employed within tanks 16A–16F, 18 are available from Rama Corporation, San Jacinta Calif., preferably model 1H8343080 is employed.

Water is supplied to the system via a pump 93 (FIG. 1), which draws water from a conventional water supply 94 via a conduit 96. A conventional motor 97, preferably electric or gasoline powered, drives pump 93. The output of pump of 93 is transmitted to a pressure regulator valve 98 via a line 99, and reaches a water input manifold 100 through an and pipe 102B. The water manifold 100 is tapped to receive a plurality of water passage conduits which inject water, as will later be described in detail, interiorly of the tank bodies 50 within each of the first stage heaters 16A–16F. During operation a water input manifold gage 103 in communication with the manifold interior enables the operator to monitor input pressure.

Figure 3:
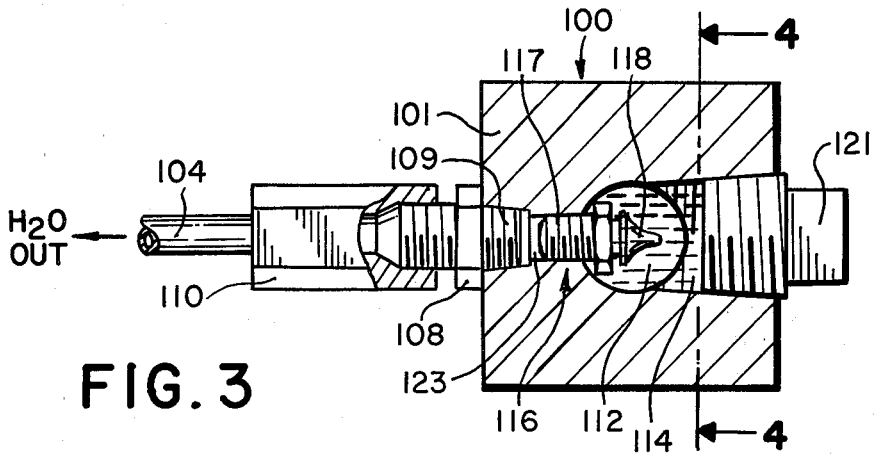
FIG. 3 is an enlarged sectional view of the manifold and internal flow constriction jet, taken generally along line 3—3 of FIG. 1, with parts thereof broken away for clarity.
Figure 4:
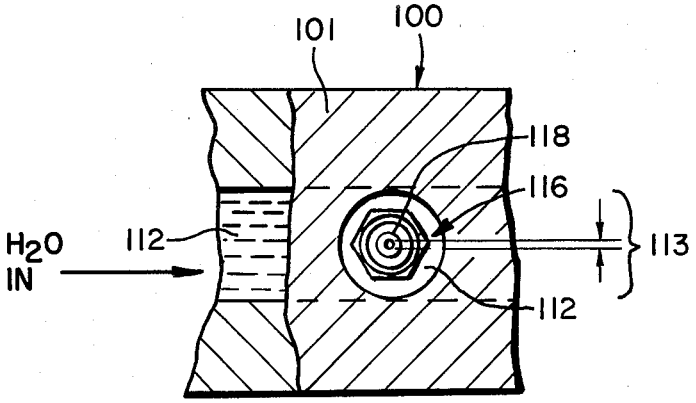
FIG. 4 is a sectional view of the manifold taken generally along line 4—4 of FIG. 3, with parts thereof broken away for clarity.

Water output passageway conduits 104, preferably of stainless steel, are secured to a tapped union 108 (FIG. 3) via a conventional flare fitting 110. The manifold 100 is of generally elongated, parallelipiped configuration, and includes an internal water reservoir provided internally of the manifold block 101. During manufacture of the manifold assembly, a larger diameter orifice 114 is machined in block 101, facilitating proper placement of an internal constriction fitting 116 terminating in a reduced diameter nozzle portion 118 which points toward the reservoir interior. It will be noted that a removable plug 121 may be threadably secured within orifice 114. The restriction nozzle 116 includes a threaded shank portion 117 which is threadably secured within a suitable tapped orifice 123, which also threadably receives threaded shank portion 109 of union 108. Importantly, the internal passageway diameter 113 of the fitting 116 is extremely fine, and experience has indicated a working dimension of 0.0004 inches. A proper operating range could vary between 0.0004 inches and 0.012 inches. It will also be noted that nozzle 118 is directed into the reservoir 112, rather than being directed into passageway 123. My experiments have indicated that plugging or blocking of the critical passageway 113 will occur much less frequently when the constriction orifice is positioned as indicated. When the constriction orifice 116 is reversed from the position shown best in FIG. 3, blocking from water scale and the like is greatly increased in frequency. Nevertheless, when maintenance is required, removal of plug 121 permits access to and removal of fitting 116.

Figure 6:
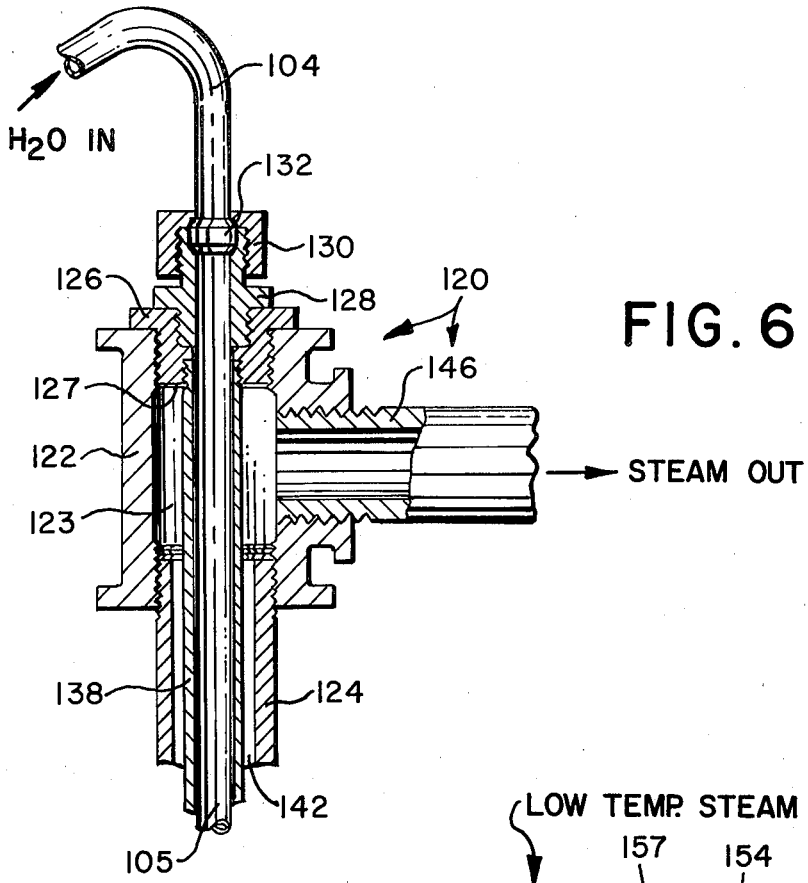
FIG. 6 is an enlarged sectional view of the water input and steam fittings employed in conjunction with the first stage heaters; and, FIG. 7 is an enlarged sectional view of the steam fitting and coupling system preferably employed in conjunction with the second stage heater.

Conduits 104 extend from manifold 100 to first stage tanks 16A-16F. The conduits 104 pass through a fitting assembly 120 (FIG. 6) and extend coaxially within the heater tanks 50, terminating in terminal end portions 105 which output steam, since, although water is transmitted out of the manifold 100, by the time water passes through the conduits 104 it will be vaporized prior to introduction into the tanks 50 because of the extreme heat encountered along the way, and, as already described, the very narrow stream of passage involved. An intermediate, rigid pipe T fitting 122 is mounted on top of a rigid, threaded pipe 124 which extends downwardly to and is threadably secured within each tank mouth 52. The upper portion of T fitting 122 threadably receives a threaded, reducer adaptor 126 which, at its upper side, threadably receives a union 128. Conduit 104 is secured relative to union 128 by a conventional compression fitting 130 which seals pipe 104 by contact with compression fitting 132. It will be noted that the lowermost portion 127 of fitting 126 is positioned within the interior 123 of fitting 122. This portion is threaded to secure an elongated, reinforcement sheath 138, which coaxially surrounds terminal portion 105 of conduit 104 to rigidly brace same. The upper end of sheath 138 is threadably received within fitting 126. Steam generated within each first stage heater 16A-16F is outputted via passageway 142, which leads to region 123 and to steam pipe 146. Pipe 146 is threadably coupled at its input end to fitting 122, and extends toward the center of the apparatus, being coupled to an extension pipe 150 via axial coupling 148. Thus relatively low temperature steam enters steam manifold 152 via each of the pipes 150 threadably, sealably coupled thereto.

Figure 7:
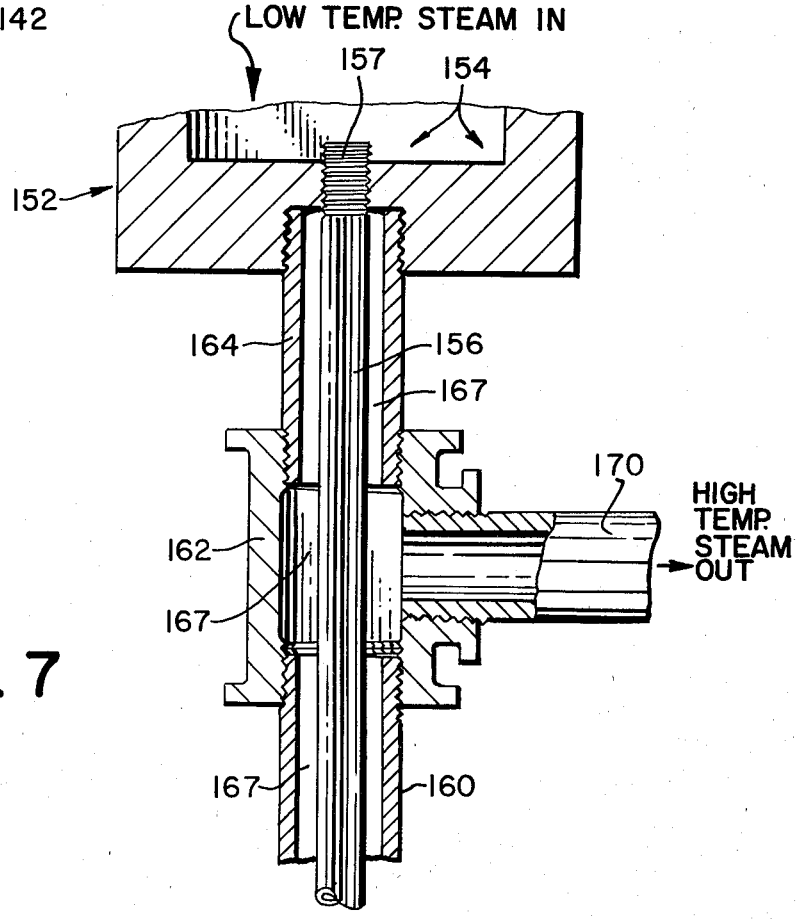

Steam entering steam manifold interior 154 (FIG. 7) is transmitted interiorly of generator 18 (i.e. within tank body 80) via conduit 156, which includes threaded shank 157 received by the manifold. Manifold 152 is supported above second stage heater 18 via a pipe 160, a pipe T-fitting 162, and another pipe 164. Pipes 160, 164 are threadably attached to fitting 162 at its bottom and top respectively. Pipe 160 is threadably secured to mouth 92; pipe 164 is threadably coupled to manifold 152. It will be noted that an internal superheated steam output passageway 167 is formed between pipes 164, 160 and internal conduit 156. Steam exhaust pipe 170 is secured to fitting 162 for outputting superheated steam 172 through orifice 174, via pressure relief valve 176 and check valve 177. Output 174 may thus be coupled to conventional conduits of a variety of types for directing superheated steam to the application involved.

Control of the apparatus is effectuated by the apparatus indicated in FIG. 5, although a variety of electrical control circuit alternatives will be satisfactory. Preferably three-phase alternating current is delivered via plug 182 and lines 184 to a circuit breaker circuit 186 housed within conventional control panel box 188. A plurality of conduits 87, 88, 77 etc. extend to separate temperature control sub-circuits for each heater tank.

Sub-circuit 190 is typical. Thermocouple 192, mechanically attached to a heater tank, such as tank 16A, privides sensing for adjustable (preferably Honeywell) temperature control 194 housed within control panel 196. Solenoid switching network 198 switches current incoming on lines 200 to heater elements 74, 75, 76 via lines 202, responsive to signals from control 194. Network 198 may comprise a Furnas Electric Co. model D2936-31 control. It should be understood that alternative temperature control and sensing networks capable of reliably energizing the heater elements will be acceptable. The proper temperature range is ideally 900-2100 degrees fahrenheit.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, ti si to be understood that all matter herein set forth or shown in accompanying drawings is to be interpreted as illustrative and not in a limiting sense.

What is claimed is:

1. A two stage, superheated steam generator comprising:

a plurality of first stage heaters for producing low temperature steam, each of said first stage heaters comprising:

a rigid, generally cylindrical first stage tank body having a mouth at one end;

a rigid, generally tubular casing coaxially surrounding said first stage tank body;

a meltable heat transfer substance disposed between said casing and said tank body;

at least one electric heating element disposed within said heat transfer substance between said casing and said tank body;

means for injecting a narrow stream of water interiorly of said first stage tank body, said last mentioned means comprising an elongated tube having at least a portion thereof extending longitudinally coaxially through the mouth of said tank body, and terminating in spaced relation to the other end of the tank body;

rigid, coaxially positioned tubular sheath means surrounding and reinforcing that portion of said elongated tube extending within said tank body;

steam output passage means for conducting steam exteriorly of said first stage tank body, said steam output passage being coaxially defined between a steam output pipe coupled to said mouth of said body and said sheath means;

primary water input manifold means for receiving incoming water and distributing water to each of said first stage heaters, said manifold means comprising:

an internal reservoir adapted to receive pressurized water from an external water source;

a pluraltiy of spaced-apart output passageways equal in number to said first stage heaters in fluid flow communication with said internal reservoir, each of said output passageways coupled in fluid flow communication with a separate one of said means for injecting a narrow stream of water interiorly of said first stage tank bodies by a conduit;

constriction means positioned within each of said manifold output passageways for severely restricting the flow of water therethrough, said constriction means including a tapered nozzle portion directed interiorly of said water manifold means toward said internal reservoir; and, a plurality of inspection orifices on said manifold means, each of said orifices being substantially aligned with a different one of said constriction means nozzle portions and each being closed by a removable plug for permitting nozzle portion maintenance;

a second stage heater for converting relatively low temperature steam to superheated steam, said second stage heater comprising:

a rigid, generally cylindrical second stage tank body for receiving low temperature steam generated by said first stage heaters;

a rigid, generally tubular casing coaxially surrounding said second stage tank body;

elongated second pipe means extending coaxially through and within said second stage tank body for delivering steam thereto;

a meltable heat transfer substance disposed between said last mentioned casing and said second stage heater tank body;

at least one electric heating element disposed within said last mentioned heat transfer substance for heating said second stage tank body; and, means for outputting superheated steam from said second stage tank;

said first stage heaters being disposed in encircling relation with respect to said second stage heater at radially spaced-apart intervals about second stage heater circumference;

a centrally disposed steam manifold for receiving steam from each of said first stage steam output passage means and coupled to said second pipe means for delivering steam to said second stage tank body; and, a plurality of radially spaced-apart, spoke-like conduits of equal length extending between said steam output passage means of said first stage heaters and said steam manifold for conducting low temperature steam thereto.

* * * * *